United States Patent [19]

Chassaing

[11] Patent Number: 4,577,419

[45] Date of Patent: Mar. 25, 1986

[54] HIGH-TOP SHOE

[75] Inventor: Jacques Chassaing, Neuwiller les Saverne, France

[73] Assignee: ADIDAS Fabrique de Chaussures de Sport, Landersheim, France

[21] Appl. No.: 596,146

[22] Filed: Apr. 2, 1984

[30] Foreign Application Priority Data

Jan. 13, 1984 [FR] France ..... 84 00488

[51] Int. Cl.[4] ..... A43B 7/20; A43B 5/00; A43B 7/14

[52] U.S. Cl. ..... 36/89; 36/58.5; 36/114; 128/80 H; 128/166

[58] Field of Search ..... 36/89, 114, 115, 117, 36/58.5, 128, 71; 128/80 H, 166

[56] References Cited

U.S. PATENT DOCUMENTS

| | | | |
|---|---|---|---|
| D. 63,721 | 1/1924 | Kezy . | |
| 76,353 | 4/1868 | Sherer . | |
| D. 97,337 | 10/1935 | Sears . | |
| D. 255,956 | 7/1980 | Hirsch . | |
| D. 272,771 | 2/1984 | Feigelstock . | |
| D. 272,964 | 3/1984 | Feigelstock . | |
| 470,316 | 3/1892 | Brown . | |
| 660,885 | 10/1900 | Brauer et al. . | |
| 703,828 | 7/1902 | Read . | |
| 892,152 | 6/1908 | Harman . | |
| 1,139,530 | 5/1915 | Johnson . | |
| 1,155,506 | 10/1915 | Osaki . | |
| 1,261,152 | 4/1918 | Mullarky . | |
| 1,283,335 | 10/1918 | Shillcock . | |
| 1,429,604 | 9/1922 | Madinger . | |
| 1,545,623 | 7/1925 | Westfall . | |
| 1,546,551 | 7/1925 | Petri . | |
| 1,663,221 | 3/1928 | Scroggins . | |
| 1,708,156 | 4/1929 | Scroggins . | |
| 1,743,689 | 1/1930 | Scroggins . | |
| 1,986,580 | 1/1935 | Johnson . | |
| 2,096,677 | 10/1937 | Fassett . | |
| 2,444,428 | 7/1948 | Carrier . | |
| 2,531,763 | 11/1950 | Andre . | |
| 2,539,761 | 1/1951 | Whitman . | |
| 2,617,207 | 11/1952 | Jennett . | |
| 2,741,039 | 4/1956 | Mathews . | |
| 2,806,300 | 9/1957 | Morgan, Jr. et al. . | |
| 2,918,734 | 12/1959 | Hyde . | |
| 2,972,822 | 2/1961 | Tanner . | |
| 3,327,410 | 6/1967 | Park, Sr. et al. . | |
| 3,408,754 | 11/1968 | Kueter | 36/117 |
| 3,456,366 | 7/1969 | Boeing . | |
| 3,464,125 | 9/1969 | Conway . | |
| 3,516,180 | 6/1970 | Thurston . | |
| 3,534,957 | 10/1970 | Norman et al. . | |
| 3,561,139 | 2/1971 | Stillman . | |
| 3,566,486 | 3/1971 | Conway . | |
| 3,613,273 | 10/1971 | Marquis | 36/89 |
| 3,977,098 | 8/1976 | Chalmers . | |
| 4,114,297 | 9/1978 | Famolare, Jr. . | |
| 4,236,328 | 12/1980 | Friedlander . | |
| 4,245,408 | 1/1981 | Larsen et al. . | |
| 4,282,657 | 8/1981 | Antonious | 36/114 X |
| 4,313,433 | 2/1982 | Cramer . | |
| 4,323,058 | 4/1982 | Detty . | |
| 4,366,631 | 1/1983 | Larsen et al. . | |
| 4,366,634 | 1/1983 | Giese et al. . | |
| 4,411,077 | 10/1983 | Slavitt | 36/89 |
| 4,440,158 | 4/1984 | Shapiro . | |
| 4,441,265 | 4/1984 | Burns et al. | 36/117 |
| 4,451,996 | 6/1984 | Norton et al. | 36/71 X |
| 4,461,288 | 7/1984 | Curtis . | |
| 4,489,719 | 12/1984 | Lapenskie | 36/89 X |

FOREIGN PATENT DOCUMENTS

| | | | |
|---|---|---|---|
| 928996 | 6/1955 | Fed. Rep. of Germany | 36/128 |
| 2527427 | 12/1983 | France | 36/115 |

*Primary Examiner*—James Kee Chi

*Attorney, Agent, or Firm*—Cushman, Darby & Cushman

[57] ABSTRACT

A high-top athletic or leisure shoe is provided, in which the top portion of the shoe leg is made of padded material which includes a piece of reinforcing material on the outer surface of the shoe at substantially the height of the outer malleolus. At least one two-segment tightening strip is provided extending from the reinforced zone. One segment of the tightening strip rises diagonally from the reinforced zone along the outer surface of the shoe leg to near the upper end of the latter at the back of the shoe, and continues substantially horizontally along the upper end of the inner surface of the shoe leg above the inner malleolus. A second segment rises diagonally from the reinforced zone, and extends across the frontal lacing area of the shoe toward the inner surface of the shoe leg. A provision is made for joining the two segments of the strip over the front and inner surface of the shoe leg so as to adjustably fasten the strip in position with a desired degree of tightness.

9 Claims, 7 Drawing Figures

HIGH-TOP SHOE

BACKGROUND OF THE INVENTION

The present invention relates to a high-top athletic or leisure shoe of the type commonly called a basketball shoe and used particularly for playing that sport.

Playing basketball submits the ankles of the player to violent stresses, due particularly to the many movements of extension involved, which are followed by sudden contact with the ground, and to the many starts for dribbling or running, which are followed by sudden stops.

It is therefore important to have shoes that ensure adequate support for the foot in the ankle area, over both the inner and outer malleolus, while also providing protection against direct shocks by means of appropriate padding.

Accordingly, shoes with reinforcing and/or tightening strips extending more or less horizontally across the shoe-top have been proposed.

Nevertheless, the shoes thus produced do not provide sufficient support for the foot and, in practice, players continue to use ankle supports or support strips inside their shoes.

SUMMARY OF THE INVENTION

The present invention proposes to provide a high-top shoe making possible the elimination of accessories such as ankle supports and having good foot-support and foot-gripping properties in the upper portion of the shoe-top or "leg" of the shoe.

The high-top shoe of the invention is of the type in which the upper part of the shoe leg is constructed of padded material and is characterized by the fact that it includes a piece of reinforcing material over the outer, i.e. lateral surface of the shoe, particularly at the level of the outer malleolus. At least one tightening strip extends from the reinforced area, with this strip having one segment that rises diagonally from the reinforced area along the outer surface of the shoe leg nearly up to the upper edge of the shoe leg at the back of the shoe, after which it continues substantially horizonally along the upper edge of the inner, i.e. medial surface of the shoe leg above the inner malleolus, with a second segment rising diagonally from said reinforced area across the lacing area at the front of the shoe towards the inner surface of the shoe leg. A means for joining the two segments of the strip over the inner and front surfaces of the shoe leg so as to hold the strip at a given degree of tightness is provided.

The joining means preferentially comprise a ring fastened to the free end of the first segment over the inner surface of the shoe leg, with the outer surface of the second segment of the tightening strip comprising two zones of complementary material capable of adhering to each other when pressure is applied and of being separated again when pulled apart, said second segment fitting into said ring and then folding back so as to bring the two zones of complementary material into contact to hold the strip.

In other words, a second segment of the tightening strip is, in the preferred embodiment of the invention, equipped with quick fastening means of the hook-and-fleece type, one brand of which is known as a "Velcro" fastener.

In a preferred embodiment of the invention, the shoe includes at the back of the leg means for positioning and guiding the first segment of the tightening strip, this means advantageously taking the form of a vertically placed slot into which said first segment of the strip is inserted at the back of the shoe. The slot may be applied to the outer surface of the shoe or, in a preferred variant, be cut out from the substance making-up the back surface of the shoe leg.

It will be understood that, when the shoe is untied or open, the tightening strip of the invention is fastened to the shoe only at the reinforced zone near the outer malleolus and therefore when one pulls on the free end of the second segment and fastens said free end after joining the two segments, the strip completely encircles the shoe, effectively gripping the foot at the ankle, while the material of the strip serves as a reinforcement. The diagonal orientation of the strip over the outer surface of the shoe leg and across the front lacing area of the shoe has been proven by experience to be particularly resistant to the violent stresses associated with playing basketball.

The reinforcing material that makes up the area of the outer surface of the shoe leg from which the tightening strip extends, as well as the material that makes up the tightening strip, may be of any appropriate type, notably real or artificial leather.

BRIEF DESCRIPTION OF THE DRAWINGS

So that the invention may be better understood, a completely nonlimitative, exemplary embodiment of the invention will now be described with reference to the drawings, in which.

Figure 1:
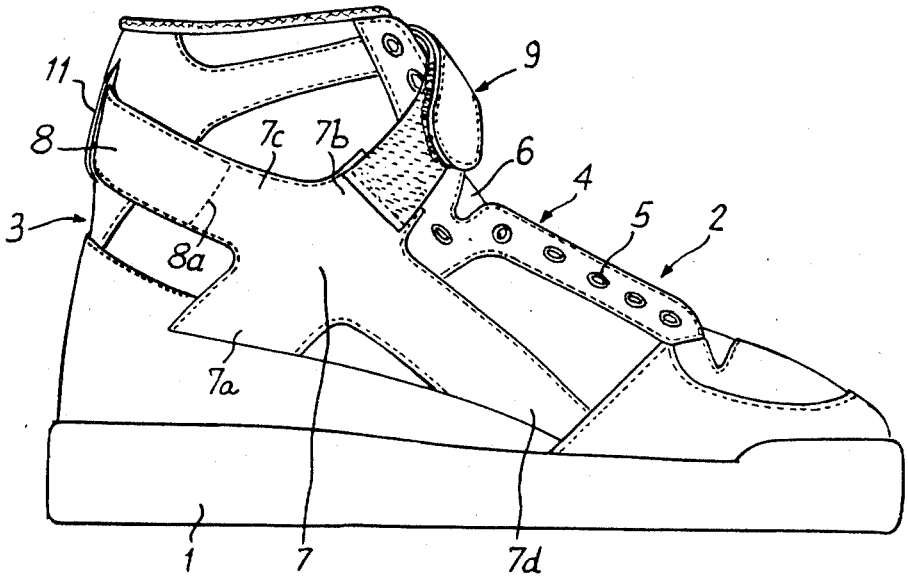
FIG. 1 is a side elevation view of the outer side of a high-top shoe embodying principles of the invention.

For convenience in illustration the conventional shoe laces are omitted in all of the views.

DETAILED DESCRIPTION

The high-top shoe of the invention, of the type used for playing basketball, comprises in conventional fashion a sole 1, an upper designated generally by the numeral 2, and a high top constructed of padded material and designated generally by the numeral 3.

At the front of the upper end of the leg is a conventional lacing area 4, with the shoe in this embodiment being done up using laces (not shown) that are inserted into grommets 5 placed on either side of the frontal opening of the shoe, into which a tongue 6 is placed in the usual manner.

In accordance with principles of the present invention, the outer surface of the shoe comprises a piece of reinforcing substance 7, e.g., leather, at the height of the outer, i.e. lateral malleolus, with extensions *7a, 7b, 7c, 7d* aligned two-by-two in generally an X-shape from the center part of the reinforcement zone.

The high-top shoe of the present invention further includes a tightening strip made up of two segments 8 and 9, which may likewise be made of leather, or the like.

Segment 8 is fastened at one end 8*a* to extension 7*c* of reinforcement zone 7, or is of one piece with it. Segment 8 is therefore fastened to the shoe-top only at end 8*a*.

Figure 2:
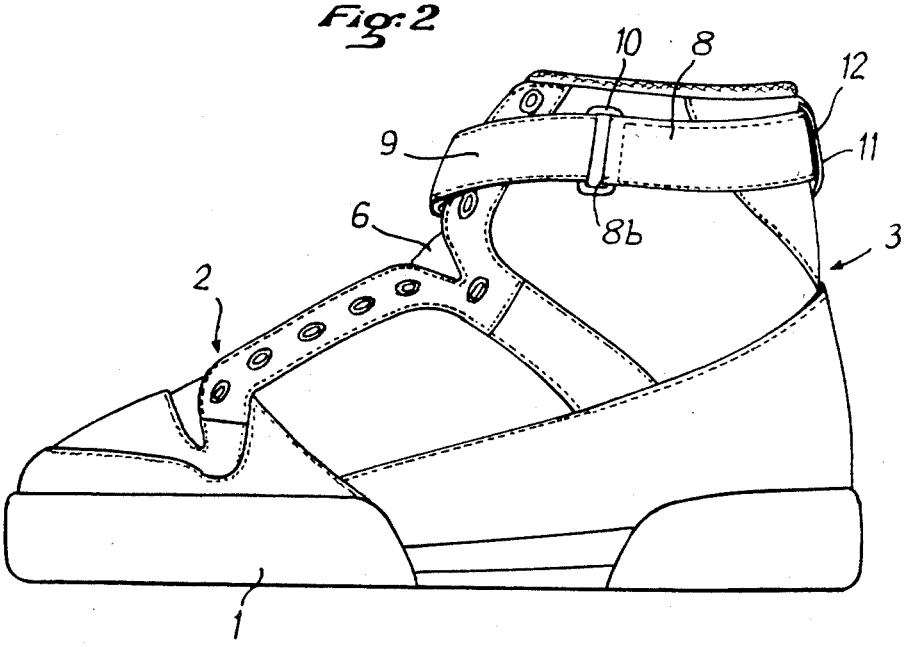
FIG. 2 is a side elevation view of the inner side of the shoe.
Figure 3:
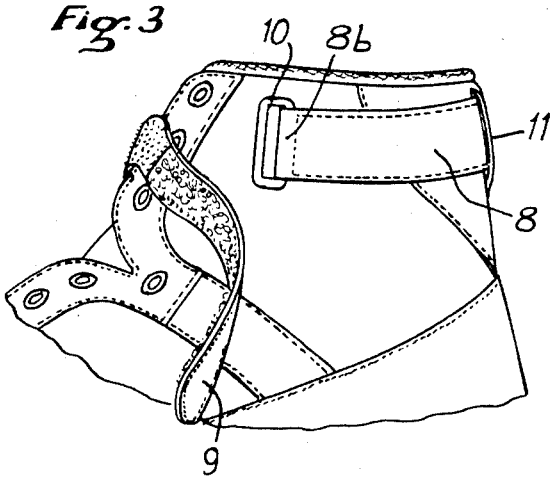
FIG. 3 is a fragmentary side elevation view of the shoe showing the inner surface of the shoe-top prior to tightening.
Figure 4:
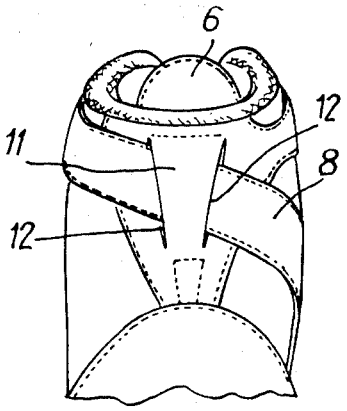
FIG. 4 is a fragmentary side elevation view of the back of the shoe-top of the shoe.

As can be seen in the drawings, particularly in FIGS. 2 and 3, the opposite end 8*b* of segment 8 preferably comprises a ring 10. Segment 8 extends from reinforcement zone 7, rising diagonally along the outer, i.e. lateral surface of the shoe-top and passing through a slot 11 at the back of the shoe-top, with said slot being either applied to the shoe-top or formed by two adjacent cuts 12 in the material of its back wall, and then extending over its inner, i.e. medial surface, more or less parallel to its upper edge, so that the ring lies in the forward part of the inner surface of the shoe-top as seen particularly clearly in FIGS. 2 and 3.

Figure 5:
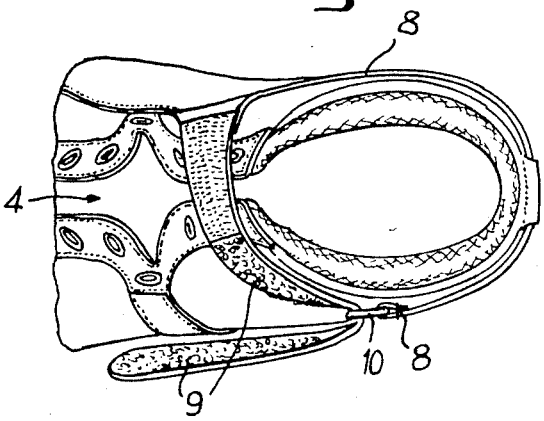
FIG. 5 is a fragmentary top plan view of the shoe prior to tightening.
Figure 6:
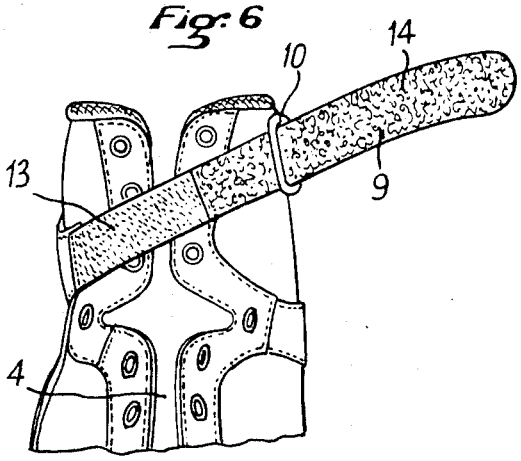
FIG. 6 is a fragmentary front elevation view of the shoe before tightening.
Figure 7:
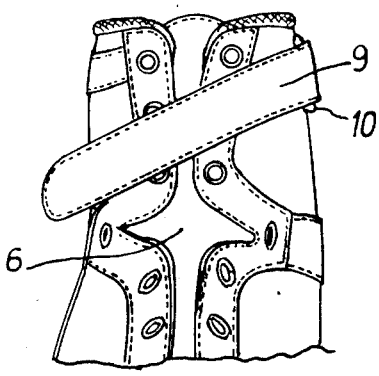
FIG. 7 is a fragmentary elevation view corresponding to FIG. 6, but after tightening.

Segment 9 of the tightening strip, as shown particularly clearly in FIG. 1, extends from extension 7*b* of the reinforcing zone, rises diagonally across lacing area 4 of the shoe, as seen best in FIG. 6, is inserted through ring 10, and is then folded back and secured on itself, as can be best seen in FIGS. 5, 6 and 7.

(In a variant that is not illustrated, segment 9 may be extended under reinforcement zone 7 up to immediately under extension 7*a* of the latter by using a length of elastic band.)

In order to fasten the strip, the outer surface of segment 9 comprises two successive zones 13 and 14 of complementary material capable of adhering when pressed together.

Zone 13 may consist accordingly of elements analogous to hooks while zone 14 is made of a substance analogous to fleece.

It will be understood that in order to use the shoe after it has been conventionally done up, e.g. by lacing, the user simply pulls on the free end of segment 9 and, after giving it the desired degree of tightness, folds it back over that part of the segment 9 that lies across the lacing area, thus fastening the strip in the position of desired tightness.

During use, this operation may be repeated to change the degree of tightness.

Although the invention has been described in connection with a particular embodiment, it is obvious that it is in no way limited to this embodiment and that various variants and modifications may be made to it without departing from the scope or spirit of the invention.

What is claimed is:

1. A high-top shoe having a high-top portion with a shoe leg made of padded material, the improvement wherein:

said shoe leg has externally secured on its outer side a piece of reinforcing material located so as to be substantially superimposed upon the outer malleolus of the shoe-wearer's ankle to provide a reinforcing zone when the shoe is worn;

at least one tightening strip extending generally around said shoe leg from said piece of reinforcing material;

said tightening strip comprising a first segment which rises obliquely from said reinforcing zone along the lateral surface of the shoe leg to adjacency with the upper edge of the shoe leg at the back of the shoe and then generally horizontally around the shoe leg to a site located above where the medial malleolus of the shoe-wearer's ankle is located when the shoe is worn;

said tightening strip further comprising a second segment which rises obliquely from said reinforcing zone along the front of the shoe leg towards the inner side of the shoe leg; and means constructed and arranged for releasably joining said first and second segments of said tightening strip to one another in at least the vicinity of said inner side of said shoe leg so as to hold said tightening strip in position with a desired degree of tightness.

2. The improved high-top shoe of claim 1, wherein:

said first segment of said tightening strip includes a free end disposed at said site;

said joining means comprises a ring fixed to said free end of said first segment of said tightening strip;

said second segment of said tightening strip including a free end portion having two longitudinally adjoining zones; and said joining means further includes two complementary bodies of fastening material which are constructed and arranged to adhere to one another until being separated by being pulled apart, each of these bodies being secured onto a respective one of said zones on said second segment of said tightening strip so that said second segment of said tightening strip when looped through said ring and doubled back upon itself so that said zones confront one another, may be pressed together and thereby joined and held tight by said fastening material.

3. The improved high-top shoe of claim 1, further comprising:

means providing a positioning guide on said shoe leg at the back of the shoe, with said first segment of said tightening strip being juxtaposed in positioned and guided relationship with said positioning guide.

4. The improved high-top shoe of claim 3, wherein:

said positioning guide means comprises means providing a pair of adjacent vertically-oriented slots on said shoe leg at the back of the shoe, with said first segment of said tightening strip being threaded in through one of these slots and out through the other of them.

5. The improved high-top shoe of claim 4, wherein:

said shoe leg, at least at the back of said shoe, is made of multiple layers of material and said slots are provided in an outer layer of said shoe leg material.

6. The improved high-top shoe of claim 1, wherein:

said piece of reinforcing material and said segments of said tightening strip are made of natural leather.

7. The improved high-top shoe of claim 1, wherein:

said piece of reinforcing material and said segments of said tightening strip are made of artificial leather.

8. The improved high-top shoe of claim 4, wherein:

said first segment of said tightening strip includes a free end disposed at said site;

said joining means comprises a ring fixed to said free end of said first segment of said tightening strip;

said second segment of said tightening strip including a free end portion having two longitudinally adjoining zones; and said joining means further includes two complementary bodies of fastening material which are constructed and arranged to adhere to one another until being separated by being pulled apart, each of these bodies being secured onto a respective one of said zones on said second segment of said tightening strip so that said second segment of said tightening strip when looped through said ring and doubled back upon itself so that said zones confront one another, may be pressed together and thereby joined and held tight by said fastening material.

9. The improved high-top shoe of claim 8, wherein: said two complementary bodies of fastening material are respectively bodies of a hook-and-fleece type of fastener.

* * * * *